US010525568B2

(12) United States Patent
Baek et al.

(10) Patent No.: US 10,525,568 B2
(45) Date of Patent: Jan. 7, 2020

(54) WAFER POLISHING SYSTEM

(71) Applicant: SK SILTRON CO., LTD., Gumi-si, Gyeongsangbuk-do (KR)

(72) Inventors: Seung Won Baek, Gumi-si (KR); Jae Pyo Lee, Gumi-si (KR)

(73) Assignee: SK SILTRON CO., LTD., Gumi-si (KR)

( * ) Notice: Subject to any disclaimer, the term of this patent is extended or adjusted under 35 U.S.C. 154(b) by 242 days.

(21) Appl. No.: 15/442,189

(22) Filed: Feb. 24, 2017

(65) Prior Publication Data

US 2018/0185982 A1 Jul. 5, 2018

(30) Foreign Application Priority Data

Jan. 3, 2017 (KR) ..... 10-2017-0000828

(51) Int. Cl.
*B24B 37/04* (2012.01)
*B24B 37/34* (2012.01)
(Continued)

(52) U.S. Cl.
CPC ..... *B24B 57/02* (2013.01); *B24B 37/04* (2013.01); *B24B 37/34* (2013.01)

(58) Field of Classification Search
CPC ..... B24B 37/005; B24B 37/04; B24B 37/34; B24B 57/02; B24B 37/00; B24C 7/00
(Continued)

(56) References Cited

U.S. PATENT DOCUMENTS 3,500,591 A * 3/1970 Keith ..... B24B 9/12 451/41
5,664,990 A * 9/1997 Adams ..... B24B 37/04 451/285
(Continued)

FOREIGN PATENT DOCUMENTS

CN 1176864 3/1998
CN 203003686 6/2013
(Continued)

OTHER PUBLICATIONS

Korean Notice of Allowance dated Aug. 29, 2018 issued in Application No. 10-2017-0000828.
(Continued)

*Primary Examiner* — Joseph J Hail
*Assistant Examiner* — Arman Milanian
(74) *Attorney, Agent, or Firm* — KED & Associates LLP

(57) ABSTRACT

The wafer polishing system is disclosed. The wafer polishing system may comprise a polishing unit; a slurry distribution unit mounted on the polishing unit and distributing a slurry flowing into the polishing unit for wafer polishing; a slurry tank connected to the slurry distribution unit and storing the slurry; a slurry pump connected to the polishing unit and the slurry tank for transferring the slurry from the slurry tank to the polishing unit; a first circulation line in which one side is connected to the slurry tank; a second circulation line in which one side is connected to the other side of the first circulation line and the other side is connected to the slurry distribution unit; and a cleaning liquid supply unit connected to the second circulation line for supplying a cleaning liquid flowing through the second circulation line.

20 Claims, 4 Drawing Sheets

(51) Int. Cl.
*B24B 57/02* (2006.01)
*H01L 21/306* (2006.01)

(58) Field of Classification Search
USPC ..... 451/60, 446
See application file for complete search history.

(56) References Cited

U.S. PATENT DOCUMENTS

| | | | | | |
|---|---|---|---|---|---|
| 5,945,346 | A * | 8/1999 | Vanell | B24B 57/02 | 438/691 |
| 5,957,759 | A * | 9/1999 | Cardenas | B01F 13/1013 | 451/60 |
| 6,123,602 | A * | 9/2000 | Rodriguez | B24B 57/02 | 451/41 |
| 6,159,082 | A | 12/2000 | Sugiyama et al. | | |
| 6,461,524 | B1 * | 10/2002 | Tsuihiji | B01D 25/164 | 210/777 |
| 6,659,848 | B1 * | 12/2003 | Craig | B24B 37/04 | 451/446 |
| 8,696,404 | B2 * | 4/2014 | Sun | B24B 57/02 | 210/195.1 |
| 2002/0052115 | A1 | 5/2002 | Crevasse et al. | | |
| 2005/0218077 | A1 * | 10/2005 | Brunsell | B01D 61/025 | 210/650 |
| 2006/0074529 | A1 * | 4/2006 | Garcia | B01F 3/0803 | 700/283 |
| 2017/0345662 | A1 * | 11/2017 | Sasaki | B24B 37/0056 | |

FOREIGN PATENT DOCUMENTS

| | | | | | |
|---|---|---|---|---|---|
| CN | 204584948 | | 8/2015 | | |
| CN | 105121095 | | 12/2015 | | |
| DE | 10032819 | | 1/2001 | | |
| EP | 0 822 033 | | 2/1998 | | |
| EP | 1 486 308 | | 12/2004 | | |
| JP | 2012-250324 | | 12/2012 | | |
| JP | 2014-124753 | | 7/2014 | | |
| JP | 2015-168035 | | 9/2015 | | |
| JP | 2015168035 | A * | 9/2015 | B24B 37/00 | |
| JP | 2016-115791 | | 6/2016 | | |
| KR | 10-1999-0056588 | | 7/1999 | | |
| KR | 20-0286821 | Y | 8/2002 | | |
| KR | 10-2002-0094814 | | 12/2002 | | |
| KR | 10-2004-0025090 | | 3/2004 | | |
| KR | 20040025090 | A * | 3/2004 | B24B 37/00 | |
| KR | 10-2005-0084139 | | 8/2005 | | |
| KR | 10-2009-0093085 | | 9/2009 | | |
| WO | WO 2004/113023 | | 12/2004 | | |

OTHER PUBLICATIONS

Japanese Office Action dated Jan. 26, 2018 issued in Application No. 2017-074969.
German Office Action dated Dec. 6, 2017 issued in Application No. 10 2017 203 575.7.
Korean Office Action dated Nov. 29, 2017 issued in Application No. 10-2017-0000828.
Japanese Notice of Allowance dated Jan. 28, 2019 issued in Application No. 2017-074969.
Chinese Office Action dated Dep. 4, 2019 with English Translation.

* cited by examiner

WAFER POLISHING SYSTEM

CROSS REFERENCE TO RELATED APPLICATION

This application claims priority under 35 U.S.C. § 119 to Korea Application No. 10-2017-0000828 filed in Korea on Jan. 3, 2017 which is hereby incorporated in its entirety by reference as if fully set forth herein.

TECHNICAL FIELD

Embodiments relate to a wafer polishing system.

BACKGROUND

Recently, the high integration of semiconductors has increased the processing and storage capacity of information per unit area. This has led to demands for large diameter semiconductor wafers, miniaturization of circuit line width, and multilayer wiring. In order to form a multi-layered wiring on a semiconductor wafer, high-level flatness of the wafer is required, and a wafer flattening process is required for such high-level flatness.

One of the wafer flattening processes is a wafer polishing process. The wafer polishing process is a step of polishing the upper and lower surfaces of the wafer with a polishing pad. The wafer polishing process is carried out using a polishing system having a polishing unit provided with an upper plate, a lower plate and a means for supplying polishing slurry to the polishing unit.

A pipe connected to the polishing unit for supplying the slurry to the polishing unit may be provided in the polishing system. However, the abrasive grains contained in the slurry may be adhered to the inside of the pipe to clog the pipe.

Furthermore, when such adhered slurry falls off and flows into the polishing unit, it may cause damage to the object to be polished and the polishing unit. Therefore, a solution to this problem is required.

SUMMARY

In one embodiment, a wafer polishing system may comprise a polishing unit; a slurry distribution unit mounted on the polishing unit and distributing a slurry flowing into the polishing unit for wafer polishing; a slurry tank connected to the slurry distribution unit and storing the slurry; a slurry pump connected to the polishing unit and the slurry tank for transferring the slurry from the slurry tank to the polishing unit; a first circulation line in which one side is connected to the slurry tank; a second circulation line in which one side is connected to the other side of the first circulation line and the other side is connected to the slurry distribution unit; and a cleaning liquid supply unit connected to the second circulation line for supplying a cleaning liquid flowing through the second circulation line.

In another embodiment, a wafer polishing system may comprise a polishing unit; a slurry distribution unit mounted on the polishing unit and distributing a slurry flowing into the polishing unit for wafer polishing; a slurry tank connected to the slurry distribution unit and storing the slurry; a slurry pump connected to the polishing unit and the slurry tank for transferring the slurry from the slurry tank to the polishing unit; a first circulation line in which one side is connected to the slurry tank; a second circulation line in which one side is connected to the other side of the first circulation line and the other is side connected to the slurry distribution unit; a cleaning liquid supply unit connected to the second circulation line for supplying a cleaning liquid flowing through the second circulation line; a flow control valve disposed in the second circulation line; a flow meter disposed in the second circulation line; a controller electrically connected to the flow control valve and the flow meter; an alarm electrically connected to the controller; and a drain line connected to the second circulation line for draining the cleaning liquid remaining in the second circulation line.

BRIEF DESCRIPTION OF THE DRAWINGS

Arrangements and embodiments may be described in detail with reference to the following drawings in which like reference numerals refer to like elements and wherein.

DESCRIPTION OF SPECIFIC EMBODIMENTS

Figure 1:
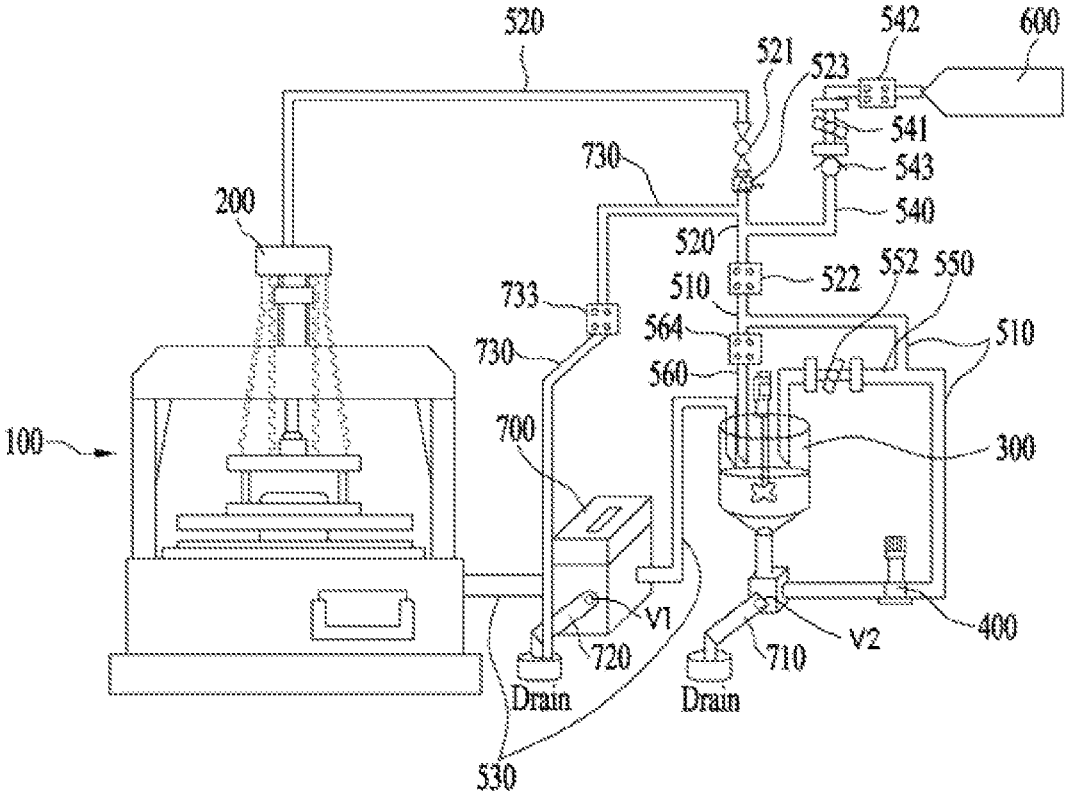
FIG. 1 is a view showing a polishing system of one embodiment.

Reference will now be made in detail to the preferred embodiments, examples of which are illustrated in the accompanying drawings. While the disclosure is susceptible to various modifications and alternative forms, specific embodiments thereof are shown by way of example in the drawings. However, the disclosure should not be construed as limited to the embodiments set forth herein, but on the contrary, the disclosure is to cover all modifications, equivalents, and alternatives falling within the spirit and scope of the embodiments. In the drawings, sizes and shapes of elements may be exaggerated for convenience and clarity of description.

It may be understood that, although the terms "first," "second," etc. may be used herein to describe various elements, these elements should not be limited by these terms. These terms are generally only used to distinguish one element from another. In addition, terms particularly defined in consideration of construction and operation of the embodiments are used only to describe the embodiments, but do not define the scope of the embodiments.

It will be understood that when an element is referred to as being "on" or "under" another element, it can be directly on/under the element, and one or more intervening elements may also be present. When an element is referred to as being "on" or "under," "under the element" as well as "on the element" can be included based on the element.

In addition, relational terms, such as "on/upper part/above" and "under/lower part/below," are used only to distinguish between one subject or element and another subject and element without necessarily requiring or involving any physical or logical relationship or sequence between such subjects or elements.

In the following, the term "line" refers to a pipe, through which wafer polishing slurry or cleaning liquid may flow. Further, the "automatic valve" is a valve that may be opened or closed using a control device remotely, and the "manual valve" means a valve that allows the operator to manually open or close.

FIG. 1 is a view showing a polishing system of one embodiment. As shown in FIG. 1, the polishing system of the embodiment may include a polishing unit 100, a slurry distribution unit 200, a slurry tank 300, a slurry pump 400, a first circulation line 510, a second circulation line 520, a third circulation line 530, and a cleaning liquid supply unit 600.

In the polishing unit 100, a wafer may be polished. For example, an upper plate and a lower plate may be provided in the polishing unit 100, the wafer to be polished may be disposed therebetween, and the wafer may be polished by rotating the upper plate and/or the lower plate.

The slurry distribution unit 200 may be mounted on top of the polishing unit 100 and may serve to distribute a slurry for wafer polishing to the polishing unit 100.

The slurry for wafer polishing may be used in polishing the wafer in the polishing unit 100. Such a polishing slurry is provided in a liquid phase in which abrasive particles and liquid are mixed, thus may circulate through a circulation line.

The polishing slurry flows into the slurry distribution unit 200 and may be uniformly introduced into the polishing unit 100 through the slurry distribution unit 200. When the polishing unit 100 and the slurry distribution unit 200 are viewed from above, the slurry distribution unit 200 may be configured such that a plurality of manifolds is formed radially with respect to the center of the polishing unit 100.

Through the plurality of manifolds having such a structure, the polishing slurry may be uniformly introduced into the upper plate and the lower plate disposed in the polishing unit 100.

Conventionally, a roller pump including a gear unit is used to introduce the polishing slurry into the polishing unit 100. However, when the roller pump is continuously used, in particular the polishing slurry wears out the gear unit, which could lead to malfunction of the roller pump.

Furthermore, the worn particles of the gear unit may damage a slurry transfer tube provided in the roller pump, or the worn particles may flow into the polishing unit 100 and cause scratches on the wafer surface to be polished.

Therefore, in the embodiment, by replacing the conventional roller pump with the slurry distribution unit 200 not provided with the gear unit, it is possible to effectively suppress damage of the slurry transfer tube in the roller pump, wafer scratch generation, and the like.

The slurry tank 300 is connected to the slurry distribution unit 200 and may store a slurry. Since a large amount of the slurry may be stored the slurry tank 300, an agitator may be provided to suppress the phenomenon that particles constituting the slurry are separated from the liquid by sinking the particles.

Although not shown, a make-up line for replenishing the slurry may be provided in the slurry tank 300, and the slurry may be replenished to the slurry tank 300 through the make-up line.

The slurry pump 400 is connected to the polishing unit 100 and the slurry tank 300, and is capable of transferring the slurry from the slurry tank 300 to the polishing unit 100.

Since the polishing unit 100, the slurry tank 300 and the slurry pump 400 are connected to each other through the first circulation line 510 to the third circulation line 530, when the slurry pump 400 pumps the slurry, the slurry may circulate through the polishing unit 100 and the slurry tank 300 through the first circulation line 510 to the third circulation line 530.

The first circulation line 510 may be connected to the slurry tank 300 at one side and connected to the second circulation line 520 at the other side and the slurry pump 400 may be disposed.

The second circulation line 520 may be connected to the other side of the first circulation line 510 at one side and connected to the slurry distribution unit 200 at the other side. The second circulation line 520 may be connected to a supply line 540 for supplying a cleaning liquid for cleaning the inside of the second circulation line 520 and a second drain line 730 for draining the cleaning liquid. The cleaning liquid may be, for example, de-ionized water.

The third circulation line 530 may be connected to the polishing unit 100 at one side and connected to the slurry tank 300 at the other side, thus the third circulation line 530 may connect the polishing unit 100 and the slurry tank 300.

The cleaning liquid supply unit 600 is connected to the second circulation line 520 and may supply the cleaning liquid flowing through the second circulation line 520. The cleaning liquid may be supplied to the second circulation line 520 for cleaning the inside of the second circulation line 520.

After the cleaning process of the second circulation line 520 is completed, the cleaning liquid remaining in the second circulation line 520 may be drained to the outside through the second drain line 730.

A drain device 700 may be disposed in the third circulation line 530 to drain the slurry flowing out from the polishing unit 100 to the outside. The slurry flowing out of the polishing unit 100 may include, for example, wafer particles and other foreign substances which are polished off from the wafer.

When a wafer polishing process continues, the content of the above-mentioned wafer particles and other foreign substances in the slurry increases, therefore, it is necessary to replace such a contaminated slurry. Accordingly, the drain device 700 may drain this contaminated slurry to the outside through a first drain line 720 connected thereto.

That is, when the contamination degree of the slurry exceeds the reference value, a part or all of the slurry is drained to the outside through the drain device 700, and the insufficient slurry may be replenished through the slurry tank 300.

The first drain line 720 is connected to the drain device 700 and may serve as a path for draining the contaminated slurry flowing out from the drain device 700 to the outside. A valve V1 may be disposed in the first drain line 720 to close or open the first drain line 720.

In addition, a third drain line 710 may be further included in the embodiment. The third drain line 710 may be connected to the first circulation line 510 and disposed below the slurry tank 300. If necessary, the slurry stored in the slurry tank 300 may be drained to the outside through the first drain line 710. A valve V2 may be disposed in the third drain line 710 to close or open the first drain line 710. The third drain line 710, the first drain line 720, and the second drain line 730 may alternatively be referred to as a first drain line 710, second drain line 720, and third drain line 730.

Furthermore, the second drain line 730 may be further included in the embodiment. The second drain line 730, as described above, may serve as a drain for draining the cleaning liquid remaining in the second circulation line 520 after the completion of the cleaning process of the second circulation line 520.

In the embodiment, a flow control valve 521 and a flow meter 523 disposed between the slurry distribution unit 200 and the second drain line 730, and disposed in the second circulation line 520 may be further included.

The flow meter 523 may measure the flow rate of the slurry supplied to the slurry distribution unit 200 and the polishing unit 100 by flowing through the second circulation line 520 when the wafer polishing step is performed.

The flow control valve 521 may control the flow rate of the slurry to be within a predetermined range based on the flow rate of the slurry measured by the flow meter 523. This flow rate control may be implemented through a controller 810, which will be described in detail below.

In the embodiment, a third automatic valve 733 may be disposed in the second drain line 730. The second drain line 730 may be opened or closed by opening or closing the third automatic valve 733.

In the embodiment, a supply line 540 may be further included. The supply line 540 may be connected to the second circulation line 520 at one side and connected to the cleaning liquid supply unit 600 at the other side. A check valve 543, a first manual valve 541, and a first automatic valve 542 may be disposed in the supply line 540.

The check valve 543 may prevent the slurry present in the second circulation line 520 from flowing back to the cleaning liquid supply unit 600. The first manual valve 541 and the first automatic valve 542 may be opened or closed to open or close the supply line 540.

When the slurry flows backward to the cleaning liquid supply unit 600, there is a possibility that various components, devices, etc. constituting the cleaning liquid supply unit 600 are seriously contaminated and damaged. Therefore, in order to prevent this surely, a check valve 543, a first manual valve 541, and a first automatic valve 542 may be disposed in the supply line 540.

In the embodiment, a second automatic valve 522 may be disposed between the first circulation line 510 and the supply line 540, and disposed in the second circulation line 520. The second automatic valve 522 may be opened or closed to open or close the second circulation line 520.

When the second automatic valve 522 is closed, the slurry does not flow through the second circulation line 520, therefore the slurry is not supplied to the slurry distribution unit 200 and the polishing unit 100 connected to the second circulation line 520.

In the embodiment, a first bypass line 550 may be disposed between the slurry pump 400 and the second automatic valve 522. The first bypass line 550 may be connected to the first circulation line 510 at one side and connected to the slurry tank 300 at the other side. A second manual valve 552 may be disposed at the first bypass line 550.

The first bypass line 550 may serve to bypass the slurry pumped from the slurry pump 400 directly to the slurry tank 300, when the polishing unit 100 stops supplying the slurry due to abnormal operation of the polishing system, failure of any part of constituting the polishing system and the like.

In the embodiment, a second bypass line 560 may be disposed between a branch point of the first bypass line 550 from the first circulation line 510 and the second automatic valve 522. The second bypass line 560 may be connected to the first circulation line 510 at one side and connected to the slurry tank 300 at the other side.

It is necessary to prevent the slurry from flowing into the second circulation line 520 and bypass the slurry to the slurry tank 300 during the course of the second circulation line 520 cleaning process. Therefore, the slurry may be bypassed to the slurry tank 300 by using the second bypass line 560.

On the other hand, since the cleaning process of the second circulation line 520 is not an emergency, it may be appropriate to use the second bypass line 560 without using the first bypass line 550 when the slurry is bypassed.

A fourth automatic valve 564 may be disposed in the second bypass line 560. As the fourth automatic valve 564 is opened or closed, the second bypass line 560 may be opened or closed.

Figure 2:
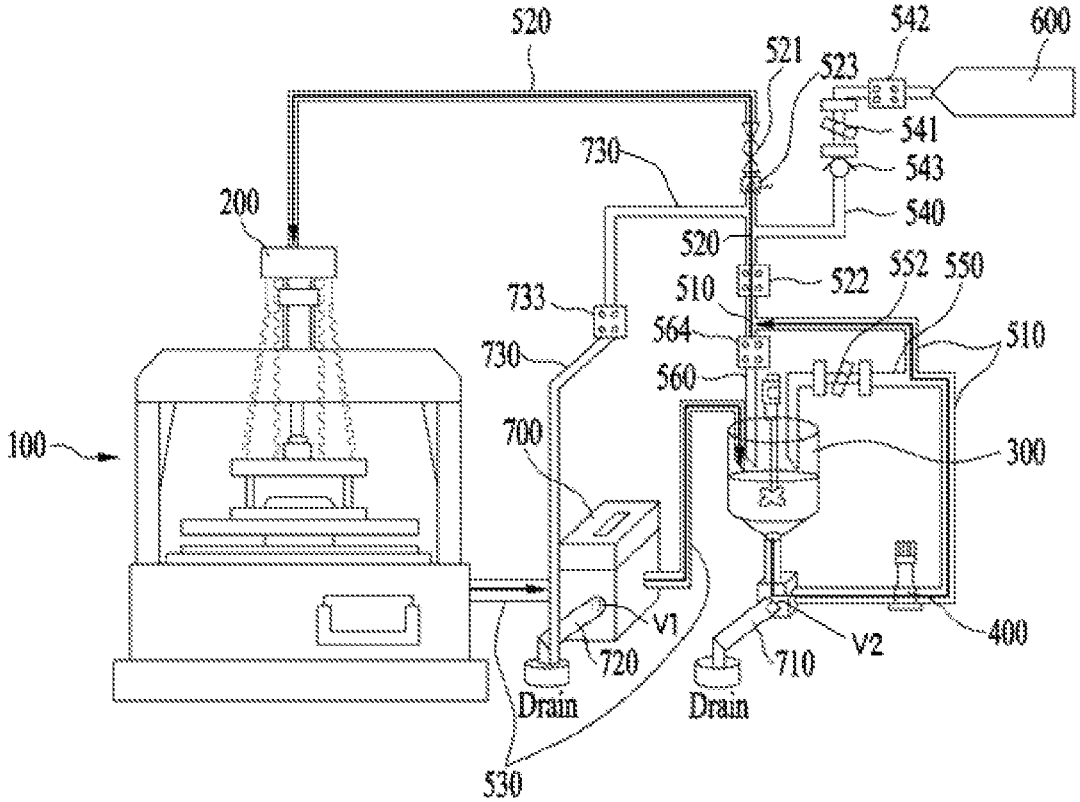
FIG. 2 is a view showing the circulation of the slurry for wafer polishing in the course of wafer polishing process in FIG. 1.

FIG. 2 is a view showing the circulation of the slurry for wafer polishing in the course of wafer polishing process in FIG. 1. During the wafer polishing process, the slurry may flow in the direction of the solid arrow.

The slurry flowing out of the slurry tank 300 is pumped by the slurry pump 400 while flowing through the first circulation line 510, at which time the valve V2 provided in the third drain line 710 may be closed.

The slurry flowing out of the slurry pump 400 flows through the first circulation line 510 and into the second circulation line 520, at which time the second manual valve 552 and fourth automatic valves 564 may be closed.

The slurry flowing into the second circulation line 520 may flow into the slurry distribution unit 200 through the second circulation line 520. At this time, the second manual valve 552 is opened, and the first manual valve 541, the first automatic valve 542, and the third automatic valve 733 are closed, and the slurry may flow through the flow meter 523 and the control valve 521, and the slurry may flow into the slurry distribution unit 200 along the second circulation line 520.

The slurry flowing into the slurry distributing unit 200 is uniformly distributed and introduced into the polishing unit 100 to be used in the wafer polishing process, and the slurry flowing out of the polishing unit 100 may be returned to the slurry tank 300 through the third circulation line 530.

At this time, the slurry passes through the drain device 700 disposed in the third circulation line 530, and the valve V1 disposed in the first drain line 720 may be closed because the slurry continues to circulate the circulation lines.

Figure 3:
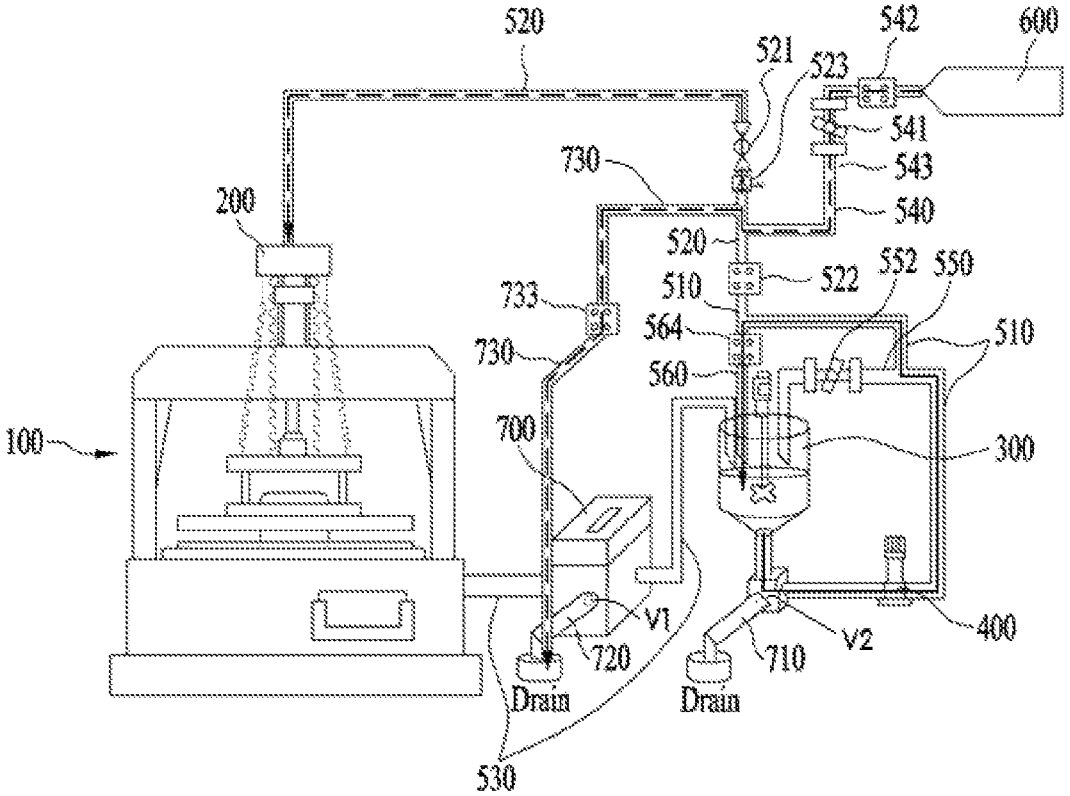
FIG. 3 is a view showing the flow of a cleaning liquid and a slurry for polishing a wafer in the course of the polishing system cleaning process in FIG. 1.

FIG. 3 is a view showing the flow of a cleaning liquid and a slurry for polishing a wafer in the course of the polishing system cleaning process in FIG. 1. In FIG. 3, hidden line arrows indicate the flow of the cleaning liquid, and solid line arrows indicate the flow of the slurry.

The inside of the second circulation line 520 directly connected to the slurry distribution unit 200 and the polishing unit 100 and supplying the slurry to them needs to be cleaned periodically or aperiodically.

If the inside of the second circulation line 520 is not cleaned, the slurry may adhere to the inner surface of the second circulation line 520, as a result, the second circulation line 520 may be blocked or the flow rate may be reduced.

When debris from the inner surface of the second circulation line 520 flows into the polishing unit 100 after the adhered slurry is grown to a certain size, scratches or other damage may be caused to the wafer, which may result in poor wafer processing.

Therefore, the second circulation line 520 may be cleaned with a cleaning liquid to solve the above-described problems. Cleaning of the second circulation line 520 may proceed to the step as follows.

First, the second automatic valve 522 is closed and the fourth automatic valve 564 is opened to bypass the slurry to the slurry tank 300. In this state, the slurry is not supplied to the second circulation line 520 after the second automatic valve 522.

In addition, the first automatic valve 542 and the first manual valve 541 are opened to supply the cleaning liquid to the second circulation line 520. At this time, the third automatic valve 733 is closed to prevent the cleaning liquid from flowing to the second drain line 730. In this state, the inside of the second circulation line 520 is cleaned for a predetermined time.

At this time, the cleaning liquid may flow into the slurry distribution unit 200 and the polishing unit 100 through the second circulation line 520. The cleaning liquid flowing out of the polishing unit 100 may be drained to the outside through the drain device 700 and the first drain line 720. Of course, the valve V1 disposed in the first drain line 720 is opened.

It is necessary to drain the cleaning liquid remaining in the second circulation line 520 after the cleaning of the second circulation line 520 using the cleaning liquid is completed.

If the wafer polishing process is performed by circulating the slurry again through the second circulation line 520 while the cleaning liquid remains in the second circulation line 520, the slurry may be diluted by the cleaning liquid to lower the polishing ability, which may increase the wafer polishing process time.

In order to solve such a problem, the process of draining the cleaning liquid remaining in the second circulation line 520 may proceed as follows.

The first manual valve 541 and the first automatic valve 542 are closed to block the flow of the cleaning liquid into the second circulation line 520. In addition, the third automatic valve 733 is opened to drain the cleaning liquid remaining in the second circulation line 520 to the outside through the second drain line 730.

In this state, some of the cleaning liquid remaining in the second circulation line 520 may be drained to the outside through the second drain line 730.

The rest of the cleaning liquid may be drained to the outside through the second circulation line 520, the slurry distribution unit 200, the polishing unit 100, a part of the third circulation line 530, the drain device 700 and the first drain line 720.

The cleaning liquid remaining in the second circulation line 520 may be very effectively drained to the outside through the two-directional passages, i.e., the first drain line 720 and the second drain line 730.

After the completion of the drain of the cleaning liquid remaining in the second circulation line 520, the second automatic valve 522 is opened again, the fourth automatic valve 564 is closed, and the valve V1 disposed in the first drain line 720 is closed. The slurry may be circulated again between the polishing unit 100 and the slurry tank 300, and the polishing process may be carried out again.

In the embodiment, the second circulation line 520 is cleaned with the cleaning liquid supplied through the supply line 540 to effectively remove the slurry adhered to the inside of the second circulation line 520, clogging of the second circulation line 520, poor polishing of the wafer, and the like may be effectively suppressed.

Furthermore, in the embodiment, after the completion of the second circulation line 520 cleaning process, the cleaning liquid remaining in the second circulation line 520 may be effectively drained to the outside through the second drain line 730. It is possible to effectively suppress the dilution of the slurry by the cleaning liquid remaining in the second circulation line 520 when the slurry is introduced into the polishing unit 100 again.

Figure 4:
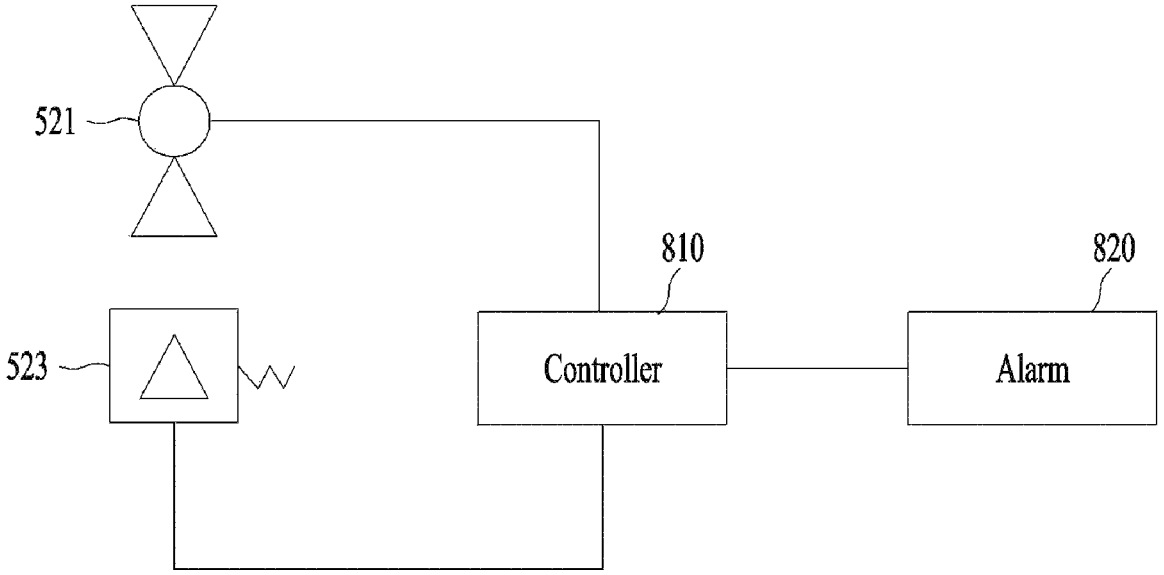
FIG. 4 is a view for explaining the control and the alarm of the polishing system of one embodiment.

FIG. 4 is a view for explaining the control and the alarm of the polishing system of one embodiment. The control and alarm of the polishing system may be performed about the second circulation line 520, and may be applied to both the polishing process in which the slurry flows in the second circulation line 520 and the cleaning process in which the cleaning liquid flows in the second circulation line 520.

However, in the following, for example, only the case of the polishing process will be described. It will be apparent to those skilled in the art from the following description that the control and alarm of the polishing system are applied to the cleaning process.

The embodiment may further include the controller 810 electrically connected to the flow control valve 521 and the flow meter 523 and an alarm 820 electrically connected to the controller 810.

The controller 810 may receive information on the flow rate of the slurry from the flow meter 523. The controller 810 may control the flow rate so that the flow rate of the slurry does not deviate from a predetermined range.

When the controller 810 sends an operation signal to the flow control valve 521, the flow control valve 521 receiving the operation signal controls the valve opening rate and the like to control the flow rate of the slurry.

A flow rate range including the upper and lower limits of the slurry flow rate flowing through the second circulation line 520 may be set and input to the controller 810. The flow rate range may be set differently when the slurry flows and when the cleaning liquid flows.

When the flow control valve 521 cannot control the slurry flow rate and the flow rate of the slurry flowing through the second circulation line 520 is out of the setting range, the alarm 820 may be operated.

That is, when the flow rate of the slurry flowing through the second circulation line 520 is out of a predetermined range, the controller 810 sends an operation signal to the alarm 820, and the alarm 820 may operate.

The operation of the alarm 820 may be implemented in various ways such as a warning sound, a warning light, a warning indication on a display device connected to the alarm 820, and the like.

In the embodiment, the flow control valve 521 may used to adjust the flow rate of the slurry or the cleaning liquid within a predetermined range, so that the polishing system may be stably operated.

Furthermore, when the flow rate control valve 521 cannot control the flow rate, if the flow rate of the slurry or the cleaning liquid deviates from a predetermined range, the alarm unit 820 operates and the operator may take quick and effective measures.

While only a few have been described above with respect to the embodiments, various other forms of implementation are possible. The technical contents of the above-described embodiments may be combined in various forms other than mutually incompatible technologies, and may be implemented in a new embodiment through this.

What is claimed is:

1. A wafer polishing system comprising:

a polishing unit;

a slurry distribution unit mounted on the polishing unit and distributing a slurry flowing into the polishing unit for wafer polishing;

a slurry tank connected to the slurry distribution unit and storing the slurry;

a slurry pump connected to the polishing unit and the slurry tank for transferring the slurry from the slurry tank to the polishing unit;

a first circulation line in which a first side is connected to the slurry tank;

a second circulation line in which a first side is connected to a second side of the first circulation line, and a second side is connected to the slurry distribution unit;

a cleaning liquid supply unit connected to the second circulation line for supplying a cleaning liquid flowing through the second circulation line;

a third circulation line connecting the polishing unit and the slurry tank;

a drain device provided in the third circulation line;

a first drain line connected to the drain device; and a second drain line connected to the second circulation line to drain cleaning liquid remaining in the second circulation line, wherein, during a polishing process, the first drain line is closed via a first drain valve and the drain device uses the third circulation line to provide the slurry entering the slurry tank from the polishing unit, and wherein, during a cleaning process, the first drain line is opened via the first drain valve and the drain device discharges a cleaning liquid flowing from the polishing unit to the opened first drain line.

2. The wafer polishing system according to claim 1, further comprising a third drain line connected to the first circulation line and provided below the slurry tank.

3. The wafer polishing system according to claim 1, further comprising a flow control valve and a flow meter provided between the slurry distribution unit and the second drain line, and provided in the second circulation line.

4. The wafer polishing system according to claim 3, further comprising:

a controller electrically connected to the flow control valve and the flow meter; and an alarm electrically connected to the controller.

5. The wafer polishing system according to claim 4, wherein the controller transmits an operation signal to the alarm when a flow rate of the slurry flowing through the second circulation line is out of a predetermined range.

6. The wafer polishing system according to claim 1, further comprising an automatic valve provided in the second drain line.

7. The wafer polishing system according to claim 1, further comprising a supply line in which a first side is connected to the second circulation line and a second side is connected to the cleaning liquid supply unit and in which a check valve, a first manual valve, and a first automatic valve are provided.

8. The wafer polishing system according to claim 7, further comprising a second automatic valve provided between the first circulation line and the supply line and provided in the second circulation line.

9. A wafer polishing system comprising:

a polishing unit;

a slurry distribution unit mounted on the polishing unit and distributing a slurry flowing into the polishing unit for wafer polishing;

a slurry tank connected to the slurry distribution unit and storing the slurry;

a slurry pump connected to the polishing unit and the slurry tank for transferring the slurry from the slurry tank to the polishing unit;

a first circulation line in which a first side is connected to the slurry tank;

a second circulation line in which a first side is connected to the second side of the first circulation line and a second side is connected to the slurry distribution unit;

a cleaning liquid supply unit connected to the second circulation line for supplying a cleaning liquid flowing through the second circulation line;

a supply line in which one side is connected to the second circulation line and the other side is connected to the cleaning liquid supply unit and in which a check valve, a first manual valve, and a first automatic valve are provided;

a second automatic valve provided between the first circulation line and the supply line and provided in the second circulation line; and a first bypass line provided between the slurry pump and the second automatic valve, in which one side is connected to the first circulation line and the other side is connected to the slurry tank.

10. The wafer polishing system according to claim 9, further comprising a second manual valve provided in the first bypass line.

11. The wafer polishing system according to claim 10, further comprising a second bypass line disposed between a branch point of the first bypass line from the first circulation line and the second automatic valve, in which one side is connected to the first circulation line and the other side is connected to the slurry tank.

12. The wafer polishing system according to claim 11, further comprising a fourth automatic valve provided in the second bypass line.

13. A wafer polishing system comprising:

a polishing machine;

a slurry distributor to distribute a slurry into the polishing machine;

a slurry tank to store the slurry;

a cleaning device for supplying a cleaning liquid;

a first circulation line connected to the slurry tank;

a second circulation line connecting the first circulation line and the slurry distributor;

a third circulation line connecting the polishing machine and the slurry tank;

a supply line connecting the cleaning device to the second circulation line;

a slurry pump provided on the first circulation line to transfer slurry from the slurry tank to the slurry distributor;

a drain device provided in the third circulation line to discharge slurry and cleaning liquid;

a first drain line connected to the drain device to discharge fluid travelling in the third circulation line; and, a second drain line connected to the second circulation line to discharge fluid travelling in the second circulation line;

a first drainage valve provided in the first drain line to open and close the first drain line, a second drainage valve provided in the second drain line to open and close the second drain line, wherein, during a polishing process, the first drainage valve is closed and slurry exiting the polishing machine travels through the third circulation line and the drain device to the slurry tank, and during a cleaning process, the first drainage valve is opened.

14. The wafer polishing system of claim 13, further including:

a cleaning valve provided in the supply line to open or close the supply line, and a slurry valve provided in the second circulation line to open and close a connection between the first and second circulation lines, wherein, during a polishing process, the cleaning valve is closed and the slurry valve is opened, and wherein, during a cleaning process, the cleaning valve is opened and the slurry valve is closed.

15. The wafer polishing system of claim 13, further including a flow control valve and a flow meter that measures a flow rate of liquid entering the flow control valve, wherein, during a polishing process, the flow control valve is configured to control a flow rate of slurry through the second circulation line to the slurry distributor and, during a cleaning process, the flow control valve is configured to control a flow rate of the cleaning liquid through the second circulation line to the slurry distributor.

16. The wafer polishing system of claim 13, wherein, during the polishing mode, slurry is configured to travel from the slurry tank to the slurry distributor and the polishing machine, during the cleaning mode, cleaning liquid is configured to travel from the cleaning device to the slurry distributor and to the second circulation line, and at an end of the cleaning mode, cleaning liquid is configured to discharge to an outside via the first and second drain lines.

17. The wafer polishing system of claim 13, further including a recirculation line connecting the first circulation line to the slurry tank and a recirculation valve to open or close the recirculation line.

18. The wafer polishing system of claim 13, further including a bypass line connecting the second circulation line to the slurry tank and a bypass valve to open or close the bypass line.

19. The wafer polishing system of claim 18, further including a slurry valve provided in the second circulation line to open and close the second circulation line, wherein the bypass line connects the first circulation line to the slurry tank, the bypass valve is provided between the slurry tank and a juncture where the first and second connection lines connect, and the slurry valve is provided between the juncture and the slurry distributor.

20. The wafer polishing system of claim 13, wherein, during the cleaning mode, slurry flows through the first circulation line.

* * * * *